US006466681B1

(12) United States Patent
Siska, Jr. et al.

(10) Patent No.: US 6,466,681 B1
(45) Date of Patent: Oct. 15, 2002

(54) WEATHER RESISTANT SOUND ATTENUATING MODULAR COMMUNICATIONS HEADSET

(75) Inventors: William D. Siska, Jr., Elma; Timothy J. Sopko, Chaffee, both of NY (US)

(73) Assignee: Comprehensive Technical Solutions, Inc., Orchard Park, NY (US)

( * ) Notice: Subject to any disclaimer, the term of this patent is extended or adjusted under 35 U.S.C. 154(b) by 0 days.

(21) Appl. No.: 09/400,574

(22) Filed: Sep. 21, 1999

(51) Int. Cl.[7] ..... H04R 25/00

(52) U.S. Cl. ..... 381/372; 381/370; 381/375

(58) Field of Search ..... 381/182, 370–372, 381/374–375, 378, 379, FOR 149, FOR 150, 383–384, 309, 368, 322, 186; 379/430, 431; 455/340, 350, 351; 181/137

(56) References Cited

U.S. PATENT DOCUMENTS 2,634,337 A * 4/1953 Bland ..... 381/322
4,302,635 A * 11/1981 Jacobsen et al. ..... 381/371
4,424,419 A * 1/1984 Chaput et al. ..... 381/191
4,499,593 A * 2/1985 Antle ..... 381/370
4,634,816 A * 1/1987 O'Malley et al. ..... 379/430
5,018,599 A * 5/1991 Dohi et al. ..... 181/129
5,185,807 A * 2/1993 Bergin et al. ..... 381/378
5,241,971 A * 9/1993 Lundin ..... 128/864
5,381,486 A * 1/1995 Ludeke et al. ..... 379/430
5,469,505 A * 11/1995 Gattey et al. ..... 379/430
5,555,554 A * 9/1996 Hofer et al. ..... 381/183
5,675,658 A * 10/1997 Brittain ..... 381/375
5,960,094 A * 9/1999 Jensen et al. ..... 381/375
6,101,260 A * 8/2000 Jensen et al. ..... 381/381

* cited by examiner

*Primary Examiner*—Curtis Kuntz
*Assistant Examiner*—P. Dabney
(74) *Attorney, Agent, or Firm*—Arthur S. Cookfair

(57) ABSTRACT

A weather resistant sound attenuating communications headset of modular construction includes two ear cup modules, a microphone boom module, a head band module, a headband cable module, and a termination cable module. The modular construction allows easy replacement of modules as well as selected components of the modules under field conditions without the need for tools. Replaceable water resistant thin film membranes are employed to provide weather protection as well as hygienic protection for the microphone, speaker and amplification electronics. The thin film membranes which cover areas which come into intimate contact with the wearer are easily replaceable under field conditions. Thus a headset that is shared by more than one user can be hygienically cleansed by simple replacement of the microphone and ear cup membranes.

12 Claims, 4 Drawing Sheets

WEATHER RESISTANT SOUND ATTENUATING MODULAR COMMUNICATIONS HEADSET

BACKGROUND OF THE INVENTION

1. Field of the Invention

This invention relates to a sound-attenuating communication headset useful in voice communications in a variety of settings.

2. Discussion of the Prior Art

Typical prior art sound-attenuating communications headsets incorporate an assemblage of components, generally including: at least one ear cup assembly including a speaker, a headband, a communications cable with a plug connector for connection to a source of electronic audio signals, a microphone boom assembly and, if there are two ear cups, an ear cup to ear cup connecting cable. Amplifier circuitry may be incorporated to provide electronic boosting of the electronic audio signal generated by the microphone. In addition, an inline push-to-talk (PTT) switch is sometimes incorporated in the communications cable. Typically, the various components are permanently fixed to other components of the headset or attached in a manner that requires the use of tools to separate them. Thus, for example, the microphone boom is typically mechanically clamped or glued to the ear cup in a permanent or not easily removable manner. Similarly, the communication cable is typically fixed in a more or less permanent manner to one of the ear cups. Within the ear cup, the speaker, as well as the circuit components, such as a printed circuit board, are generally connected by soldered junctions. Generally the repair or replacement of parts in such units must be done at a workbench rather than in the field. The microphones as well as the speakers, used in communications headsets, are generally susceptible to deterioration when exposed top water or water vapor, such as during use in adverse weather conditions. Typically, microphones and speakers are covered by a fine metallic screen or a plate with a series of small holes for the transmission of sound. The small openings in such covers may inhibit the passage of liquid water (not water vapor). However, water may form a film over the small openings and interfere with the transmission of sound.

U.S. Pat. No. 3,562,451 discloses a microphone and headset for use in aqueous environments and constructed with waterproof connections.

U.S. Pat. No. 4,875,233 discloses a communication headset having an earpiece assembly mounted on one end of a headband and a microphone retained thereon by an adjustably moveable boom.

U.S. Pat. No. 4,993,065 discloses an accessory communication device for telephone sets wherein a harness, to be worn around the user's neck, has a microphone unit and a pair of earphones detachably fixed thereto.

U.S. Pat. No. 5,369,857 discloses a method of making a telephone headset wherein the headband and the microphone boom are formed by extruding a thermoplastic while simultaneously feeding two wires through the extrusion die. The resultant extrusion comprises two parallel lengths of solid conductive wire embedded in a thermoplastic extrusion. The wires serve to stiffen the extrusion and serve as electrical conductors.

U.S. Pat. No. 5,450,496 discloses a communications headset having a detachable receiver capsule rotatably and pivotally attached to a main body, and a cable pivot for allowing the headset connection cable to pivot with respect to the receiver capsule.

There remains a need for an improved sound attenuating communications headset suitable for use under varying environmental conditions and conveniently repairable or reconfigurable under field conditions.

It is an object of the present invention to provide a new and improved communications headset of modular construction that permits convenient repair or reconfiguration under field conditions by simple replacement of modules or components with similar or alternate modules or components, as necessary, without the need for tools.

It is a further object to provide a communications headset that is sufficiently water resistant to permit use in adverse weather conditions.

It is a still further object to provide a communications headset suitable for sharing in use between more than one user that can be hygienically cleansed by a simple procedure.

SUMMARY OF THE INVENTION

The above and other objects are achieved in accordance with the present invention, which provides a weather resistant sound attenuating communications headset comprising an assemblage of replaceable modules including:

a) a primary ear cup receiver module comprising an ear cushion, an ear cup membrane, an ear cup cushion plate, an ear cup foam sound barrier, an ear cup speaker, a printed circuit board assembly, and an ear cup shell;

b) a termination cable module adapted at one end for removable connection to said ear cup assembly and at another end for removable connection to a unit for the transmission and reception of electrical communication signals;

c) a headband module adapted for removable attachment on one end thereof to said first ear cup assembly module for securing and positioning said ear cup assembly module to engage a user's ear;

the ear cup membrane being replaceably attached over the foam cover, speaker, and printed circuit board assembly to provide an hygienic and protective cover therefor.

The communications headset of this invention may be constructed as a monaural headset, that is, having a single ear cup receiver assembly module, or, preferably as a binaural headset wherein a second ear cup receiver assembly module is removably attached to a second end of the headband module to provide audio reception for each ear of the user. In the binaural headset embodiment, an additional module—a headband cable module—is included for the transmission of electronic signals from the termination cable module attached to the primary ear cup receiver module to the second ear cup receiver module. The headband cable module may be removably attached to the headband module and conformable thereto. For the transmission of electronic signals, the headband cable module may have a connector, such as a coaxial connector, on each end, for removable connection, in a known manner, to each ear cup receiver module.

The present communications headset is well suited for a variety of uses, particularly for uses in outdoor settings where adverse weather conditions and rough treatment are encountered. For example, in use by an airport ground crew, the termination cable may be plugged into a receptacle near the front of an airplane to provide a communications link to the cockpit. In a hurried disconnect, the end of the terminations cable is sometimes dropped and dragged on the ground and damaged as a result. Because of the modular construction of the present headset, the cable may be quickly and easily replaced in the field without the need for tools.

For use in two way communication, the communications headset of this invention may include a microphone, preferably a noise canceling microphone, held in a microphone boom module adapted for positioning the microphone at a suitable position with respect to a user's mouth. The microphone boom module includes a flexible boom adapted at one end for removable connection to the primary ear cup receiver module. The connection provides a mechanical attachment to the ear cup as well as an electrical connection to the speaker within the ear cup. The microphone is held within a microphone housing at the other end of the boom. The microphone housing is covered with a microphone cover assembly comprising a protective membrane sealed within the microphone cover. The microphone cover assembly is removably attached to the microphone housing, for example by a "snap fit" onto the microphone housing. The flexible metal boom is preferably covered with a protective sleeve to provide additional water resistance. The protective sleeve is preferably a thin plastic or elastomer, such as heat shrinkable plastic cover or elastomeric tubing or sleeve.

The protective membrane sealed within the microphone cover is waterproof and serves to protect the microphone from the environment. The microphone cover assembly, including the membrane can be easily removed and replaced with no tools required. This offers a specific hygienic advantage in that the cover assembly, that is, the part that is near or in touch with the user's mouth during use, can be easily replaced in the field when the headset is transferred to a new user. Similarly, the ear cup membrane serves to protect the components in the inner part of the ear cup receiver module, especially the speaker and printed circuit board, if present, from the environment. It also provides an hygienic advantage in that the membrane and the ear cup cushion, the parts that may be in touch with the user's ear during use, can be easily replaced in the field, without tools, when the headset is transferred to a new user.

The water resistant thin film membrane material employed as a protective cover for the microphone as well as the speaker and amplification electronics in the ear cup receiver module(s) is a particularly advantageous aspect of the present invention. In each instance, that is, in the ear cup and in the microphone cover assembly, the membrane may be of the same or similar material, such as a flexible elastomeric film or sheet, but may vary somewhat in properties as well shape. The membranes may be fabricated from a variety of flexible polymeric thin film sheet materials, the preferred being a flexible thermoplastic polyurethane film such as the JPS polyurethane film available from JPS Elastomerics Corp, Northampton, Mass. The thin film membrane covering the microphone is approximately the size and shape of a small thimble, that is, about ½ inch diameter by ½ inch long, tapering to a closed end. To achieve the desired properties, that is, preventing contamination from environmental agents as well as transmitting sound, the thickness of the membrane can be as great as 0.004 inches thick near the open end, thinning down quickly to no greater than about 0.001 inches for the rest of the membrane. The primary concern relative to environmental contamination is water and water vapor. If the microphone is exposed to water or water vapor, it will, in time become compromised and fail to function. A typical microphone incorporates either a very fine metallic screen or a plate with a series of small holes. Such coverings rely on the surface tension of water, a highly polar molecule, to prevent water molecules from passing through. Often in rainy weather conditions this results in the formation of a film of water across the surface of the protective screen and tends to inhibit the transmission of sound. Such protection is only minimally effective for incidental contact with water droplets, such as would be encountered in a light rain or water sprinkle. However, in many uses the microphone is exposed to heavy rains and even water submersion as well as high humidity from the user's exhaled breath and/or ambient air. In high humidity, water vapor passes easily through the screen or holes and ultimately condenses back to liquid water on the inside of the microphone element. Frequently, a microphone used in outdoor environments is exposed to other contaminants, such as salt, which may result corrosion. The membrane employed in the present communications headset resolves such problems by completely isolating the microphone element from the ambient atmosphere. The membrane is sealed in a watertight manner at its base, that is at the open end, to the inside of the microphone cover. Thus, in the present invention the membrane-protected microphone can be exposed to liquid water and water vapor as well as other liquids and vapors without deleterious effect. The chemical resistance and compatibility of the membrane material will dictate which chemicals the microphone boom module can be exposed to. The mechanical properties of the membrane as well as its shape and thickness may affect the sound wave transmission of the microphone element. In general, the greater the hardness or stiffness of the membrane material, the more important it becomes that the thickness be minimal. The distance that the membrane is from the face of the microphone is also important. If the distance is too great, the sound waves will not be transmitted to the microphone clearly. Typically, it is preferred that the distance between the face of the microphone and the membrane is between about 0.002 to 0.008 inch. At lesser distances feedback may become a problem. At greater distances sound wave transmission may deteriorate.

In order for the membrane to allow adequate sound transmission to the microphone, it must remain flexible. Occasionally, environmental changes in pressure, such as during shipment in an aircraft, may cause a pressure differential across the membrane, resulting in reduced flexibility of the membrane. To compensate for such changes in pressure, it has been found preferable to pierce the membrane, using for example, a very sharp-pointed pin or needle. The resultant puncture in the membrane will then function as a pressure release valve when a pressure differential occurs and will close when the pressure is nearly equalized. Thus, the puncture will allow for pressure equalization while still maintaining the integrity of the membrane and its ability to prevent the passage of water and water vapor during normal use.

The other thin film membrane incorporated in the present headset, the ear cup membrane, may be made of a similar or same material as the microphone cover membrane but will vary somewhat in properties and shape. This membrane is designed to fit into the ear cup in such a way that it forms a contamination barrier between the internal components of the ear cup and the ambient surroundings. The ear cup membrane has a uni-planar flange area forming the outside perimeter and shaped to match the ear up cushion and be mechanically held between the ear cup cushion and the ear cup plate. preferably, the flange area of the membrane is approximately 0.005 inches thick. The center region of the membrane is concave in shape recessing into the internal pocket portion of the ear cup. The membrane thickness of this center region is preferably no greater than about 0.001 inches thick in order to allow acceptable transmission of sound waves between the headset speaker and the user's ear.

BRIEF DESCRIPTION OF THE DRAWINGS

The present invention and the manner in which it may be practiced is further illustrated with reference to the accompanying drawings wherein.

DETAILED DESCRIPTION OF THE INVENTION AND PREFERRED EMBODIMENTS

Figure 1:
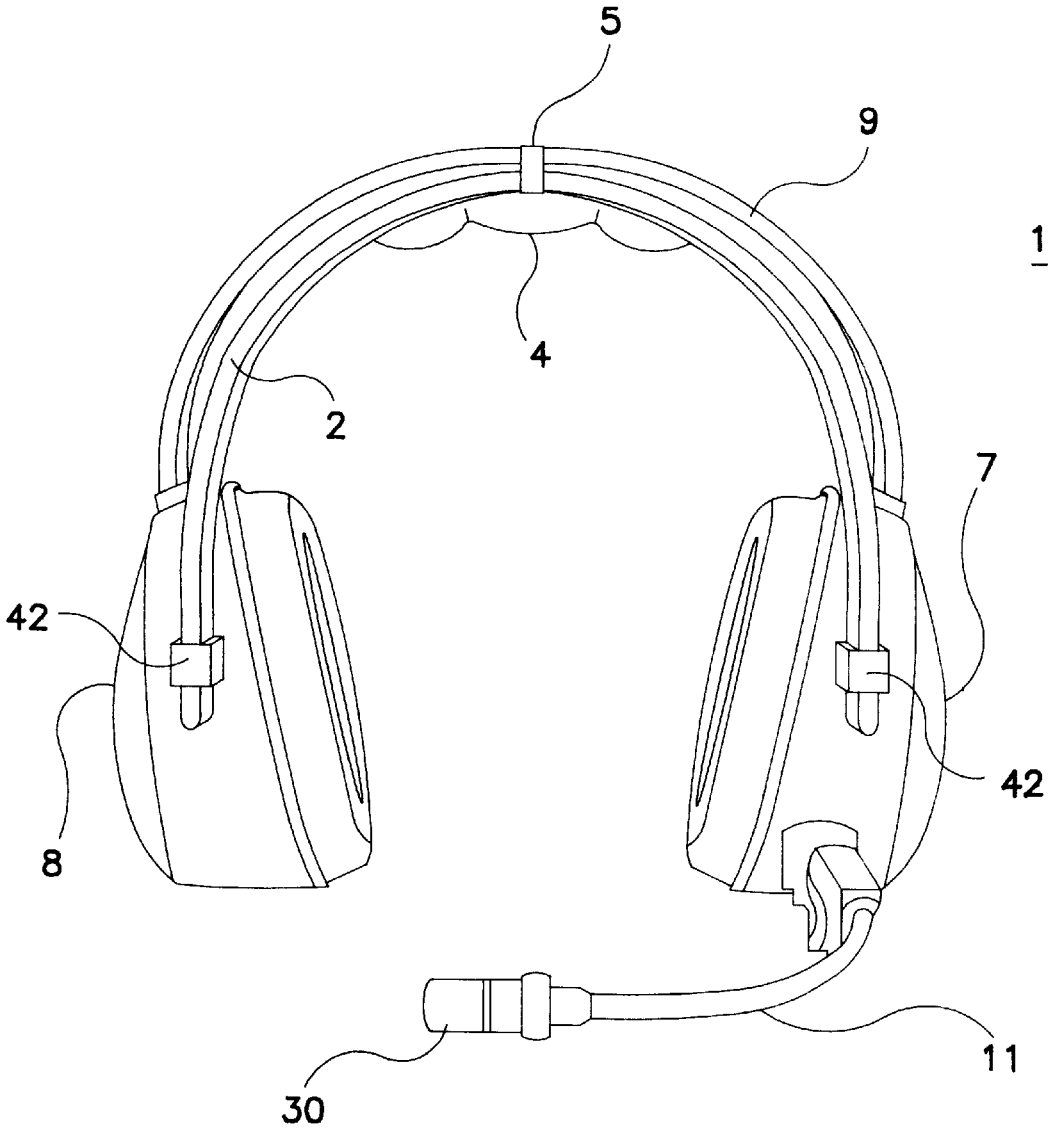
FIG. 1 is a perspective view of a communications headset according to the invention.

In the accompanying drawings, since the internal wiring and electrical circuitry within the various modules of the present communications headset is conventional and well known to those skilled in the art, description and illustration thereof is omitted for simplicity. With reference to FIG. 1, an embodiment of the present invention is shown comprising a primary ear cup receiver module 7 and a second ear cup receiver module 8, both held in place by headband module 2, removably attached at each end to clips 42 on each ear cup, and electrically connected by a headband cable module 9. The headband cable module 9 is held in place by a replaceable headband cable retainer 5. The headband cable module 9 contains conventional internal wiring (not shown) to transmit electrical communication signals to ear cup module 8. A microphone 23 is housed in microphone boom module 11 connected to ear cup module 7. A headband cushion 4 is affixed to the underside of the headband module 2.

Figure 2:
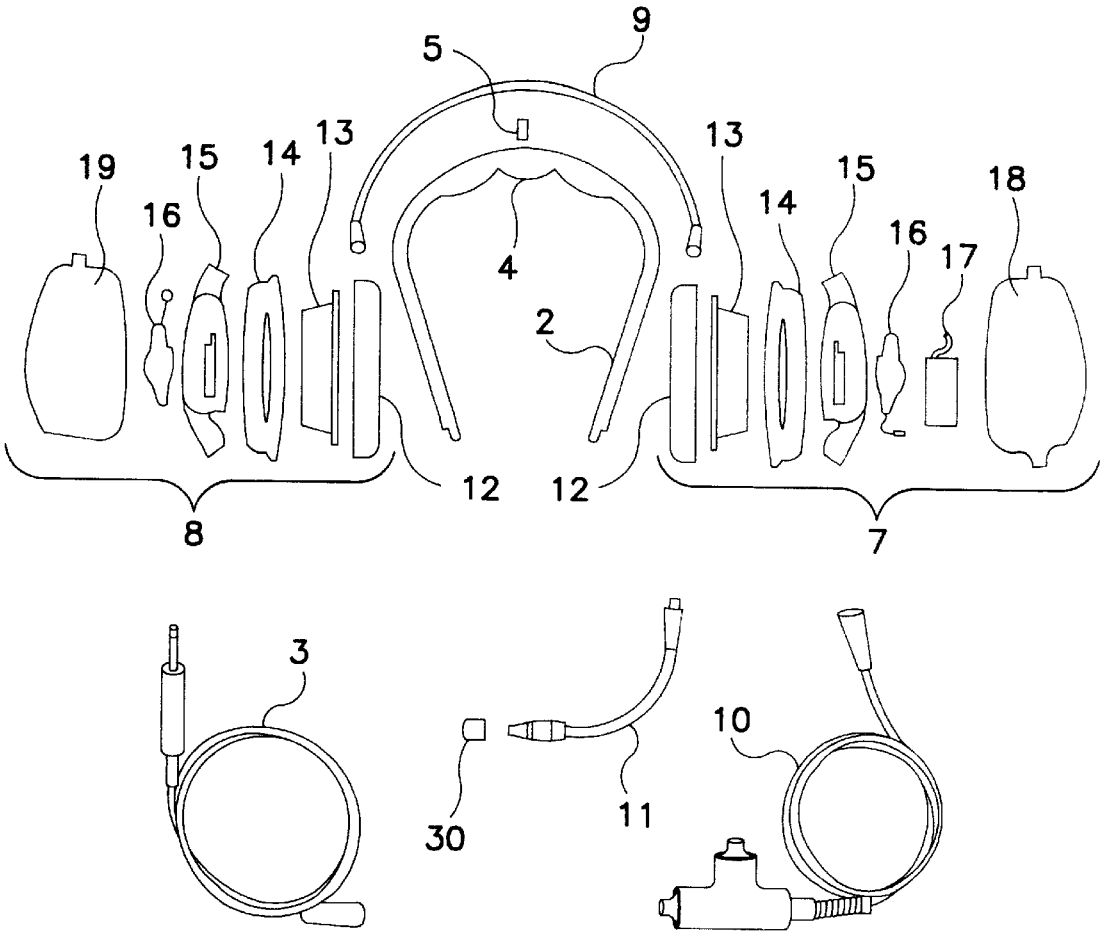
FIG. 2 is an exploded view of a communications headset of the invention showing the modular construction.

In FIG. 2, a communications headset of this invention is depicted in an exploded view to illustrate the various modules and components that may be assembled to form the headset. Each of the modules shown may be quickly and conveniently replaced, with no tools required, to permit repair as needed under field conditions. The easily replaceable or reconfigurable modules of the various embodiments include the headband module 2, the primary ear cup receiver module 7, the second ear cup receiver module 8, the headband cable module 9, the microphone boom module 11, the termination cable module 3, and the push-to-talk (PTT) module 10. The headband module 2 comprises a headband which may be made of a suitable material, such as metal or plastic, preferably an injection molded thermoplastic, configured at each end to hold an ear cup in a removably attached manner, such as by a pressure fit or a snap-fit connection into clips 42. The other modules may be removably connected, both physically and electrically, using watertight plug and jack type connectors, such as those manufactured by Conxall Co. and others. The headband module 2 may, preferably, have a permanently adhered head foam cushion 4 affixed thereto. A retainer clip 5, made, for example, of metal wire or plastic, may be removably attached or permanently affixed to the headband for holding a headband cable module 9 in place. The headband cable module 9 is formed with connectors crimped on each end for convenient attachment and removal from each ear cup module to provide electrical communication between the ear cups. The headband cable module 9 may be conveniently replaced if necessary, under field conditions without the need for tools. A termination cable module 3 is adapted at one end for removable mechanical and electrical connection to one of the ear cups and at the other end for removable mechanical and electrical connection to a source of electrical communication signals. For the removable mechanical and electrical connections, the termination cable is provided with suitable connectors such as plugs or jacks at each end, permanently attached and preferably water tight. In a preferred mode, the termination cable module 3 comprises a four conductor cable having a 3-conductor phenotype plug (stereo plug) on one end, for connection to a source of electronic communication signals and a 4 conductor receptacle on the other end. In many field uses, the termination cable receives rough treatment and likely damage, especially at the outer end of the cable. It is a particular advantage of the present communications headset that the termination cable module 3 is conveniently field replaceable with no tools required.

Optionally, the headset of the present invention may be provided with a PTT cable module 10 adapted for removable electrical and mechanical connection to the termination cable module 3 at one end and the headset (ear cup module 7) at the other end, to control the transmission of electronic audio signals. The PTT cable module which may be used in the present invention preferably comprises a suitable length of four-conductor cable having a four-conductor receptacle at one end and a PTT switch with a plug at the other end. The module is preferably watertight and is conveniently replaceable under field conditions with no tools required.

Figure 3:
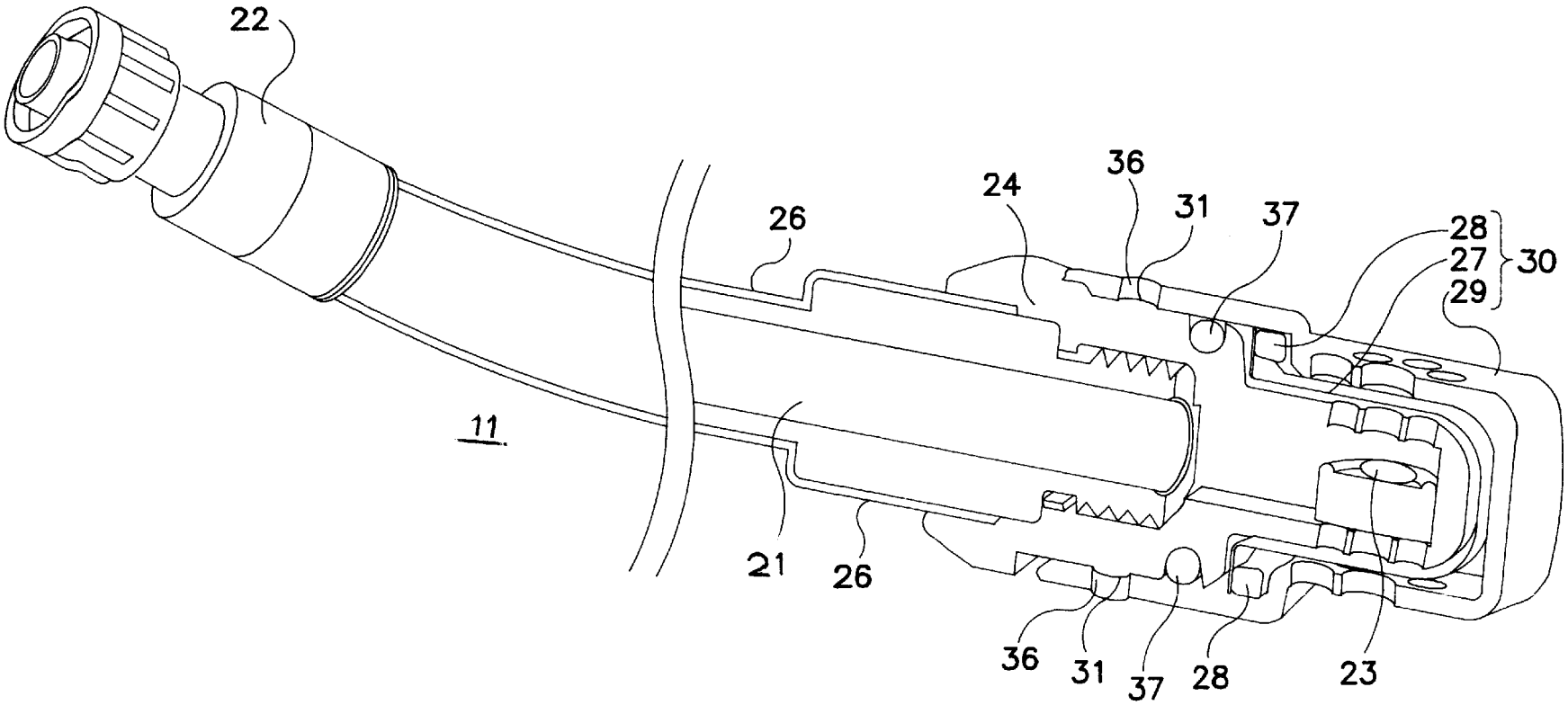
FIG. 3 is a side cross-sectional view of a microphone boom module of the present invention.

The microphone boom module 11, depicted in detail in FIG. 3, comprises a flexible boom 21, which may, for example, be of metal or plastic, having a circular connector 22, such as a two conductor plug, on one end and a microphone 23, microphone housing 24, microphone membrane 27 and microphone cover 29 on the other end. The microphone boom 21, preferably a flexible metal boom, is covered with a protective sleeve 26, which may be formed, for example, from a heat shrink plastic sheeting. The circular connector 22 connects to jack 40 (FIG. 4B) in primary ear cup receiver module 7. The microphone housing 24 may be connected to the microphone boom 21 by a threaded connection or a pressure fit or snap fit or other connection. The microphone housing 24 is covered by a membrane 27 held in place within the microphone cover 29 by a sealant or by a retaining ring 28 or both. The microphone cover 29 and the microphone membrane 27 held therein with the aid of retaining ring 28 form a microphone cover assembly 30 which can be conveniently removed and replaced as needed.

Since the microphone and microphone cover in a communications headset must be situated near the mouth of the user, it is subject to contamination by contaminants, such as airborne pathogens, from the user's mouth. Such contamination presents a problem when the headset must be shared by other users. The headset of the present invention provides a particular hygienic advantage since the microphone is protected by a membrane 27 and cover 29 which can be conveniently replaced in the field, as a part of microphone cover assembly 30 when the headset is transferred to a different user.

The microphone housing 24 which holds the microphone 23 is shaped with protrusions 31 that fit into a concavity 36 on the inner side of cover 29 and thus permits the microphone cover assembly 30 to be held in place and to be easily installed by simply snapping into place or easily removed and replaced by hand conveniently without the need for tools. The microphone housing 24 also incorporates an o-ring 37 that forms an hermetic seal between the microphone housing 24 and the cover 29.

Figure 4B:
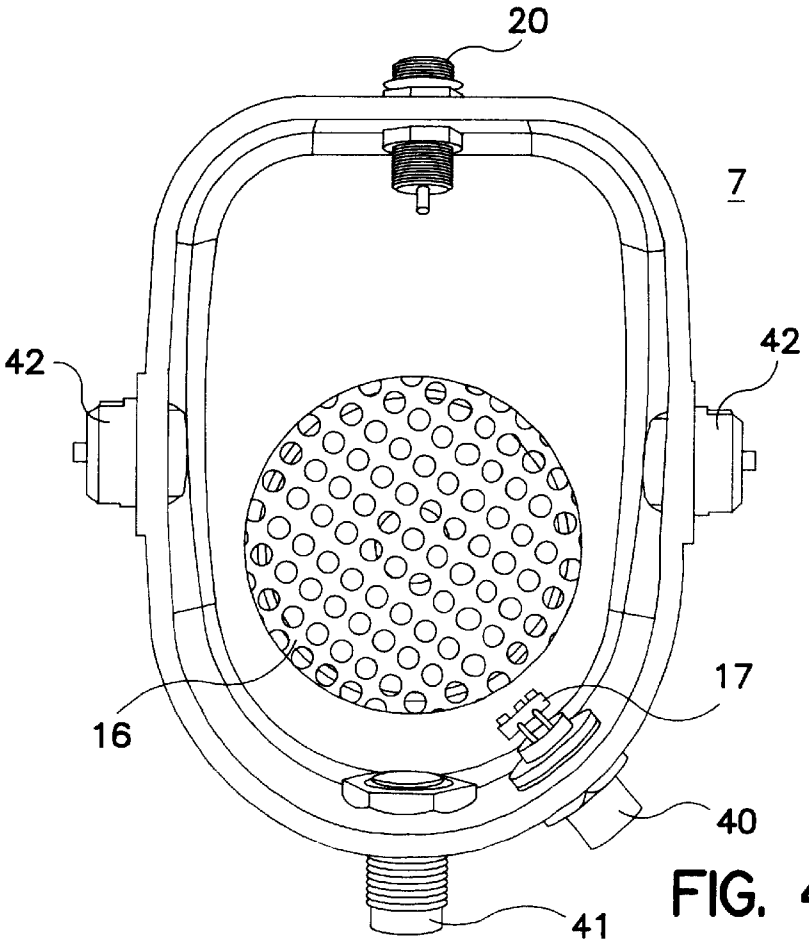
FIG. 4*b* is a perspective view of the inside of the primary ear cup receiver module, with some components removed.
Figure 4A:
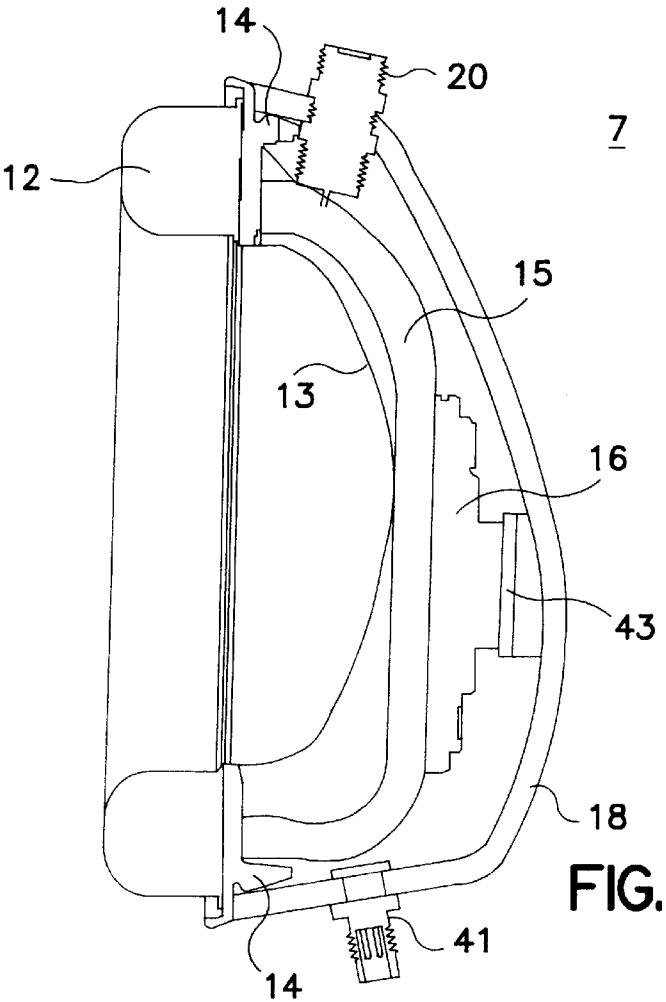
FIG. 4*a* is a side cross-sectional view of a primary ear cup receiver module in accordance with the present invention.

As shown in FIG. 4A, the primary ear cup receiver module 7 is provided with a jack 40 for connection to a plug, such as circular connector 22 at the end of microphone boom module 11. Primary ear cup module 7, as shown in detail in FIGS. 2 and 4A–4B comprises an ear cushion 12, an ear cup membrane 13, ear cup plate 14, sound attenuating ear cup foam barrier 15, ear cup speaker 16, a printed circuit board 17, and an ear cup shell 18 having jacks 20, 40, and 41 for accepting headband cable module 9, microphone boom module 11, and termination cable module 3, respectively. In FIG. 4B, the ear cup plate, membrane, and foam barrier have been omitted for clarity of other components. The speaker 16 is held in place by a hook and loop attachment 43 to the inside of shell 18 (FIG. 4A). Alternatively in place of the hook and loop attachment, there may be used a snap or other type of attachment. The speaker 16 and printed circuit board 17 (FIGS. 4*a* and 4*b*) are conveniently removable components of the ear cup module and may be electrically connected through use of known connectors, such as plugs, jacks, or the like, for convenient disconnection and replacement. Thus, for example, the printed circuit board 17 that contains the circuitry to communicate electrical signals to or from the speaker, the microphone, and the termination cable may have three mini-plugs for connection to wires from those components. By simple disconnection of those plugs, the printed circuit board 17, as well as speaker 13, can be easily replaced if necessary during use in the field without the use of tools.

The components of second ear cup receiver module 8 are similar to those of the primary ear cup module 7 except that a printed circuit board is not necessary and the second ear cup shell 19 does not require means for accepting connectors from the termination cable module and the microphone boom module. If desired, the ear cup modules may be adapted to permit the removable attachment of the microphone boom module 11 and/or the termination cable module 3 to ear cup receiver module 8.

Although the invention has been described with reference to certain embodiments, it will be appreciated by those skilled in the art that modifications and variations may be made without departing from the spirit and scope of the invention as defined by the appended claims.

What is claimed is:

1. A communications headset comprising an assemblage of individually replaceable modules including a) a primary ear cup receiver module comprising
an ear cushion
an ear cup membrane
an ear cup plate
an ear cup foam sound barrier
an ear cup speaker
a printed circuit board
an ear cup shell;

b) a termination cable module adapted at one end for removable connection to said ear cup receiver module and at another end for removable connection to a source of electrical communication signals;

c) a headband module adapted at one end thereof for securing and positioning said ear cup receiver module to engage a user's ear;

said ear cup membrane being replaceably attached over said foam sound barrier, speaker, and printed circuit board to provide an hygienic and protective cover therefor and being removable and replaceable by hand without the need for tools;

said individually replaceable modules being replaceable by hand without the need for tools.

2. A communications headset according to claim 1 further comprising a second ear cup receiver module removably attached to a second end of said headband module and a headband cable module removably connected to said first ear cup receiver module and said second ear cup receiver module for transmitting electrical communications signals to a speaker in said second ear cup receiver module, said second ear cup receiver module comprising an ear cushion an ear cup membrane an ear cup plate an ear cup foam sound barrier an ear cup speaker and an ear cup shell;

said ear cup membrane being removable and replaceable by hand without the need for tools;

said headband cable module being removable and replaceable by hand without the need for tools.

3. A communications headset according to claim 2 wherein said ear cup membrane in said primary ear cup receiver module and said second ear cup receiver module are each a polyurethane membrane.

4. A communications headset according to claim 2 wherein said microphone membrane is held within a microphone cover assembly, said cover assembly being removably attached to said microphone boom and removable and replaceable by hand without the need for tools.

5. A communications headset according to claim 4 further comprising push to talk cable module adapted for removable connection to said termination cable module and being removable and replaceable by hand without the need for tools.

6. A communications headset according to claim 2 wherein said speaker in said primary ear cup receiver module and said second ear cup receiver module are each removable and replaceable by hand without the need for tools.

7. A communications headset according to claim 2 wherein said printed circuit board is removable and replaceable by hand without the need for tools.

8. A communications headset according to claim 1 further comprising a microphone boom module comprising:

a flexible boom, housing a microphone at one end thereof and being removably attached at an opposite end thereof to said primary ear cup module; said microphone being covered by a protective microphone membrane and microphone cover assembly;

said microphone boom module being removable and replaceable by hand without the need for tools; and said microphone membrane and microphone cover assembly being removable and replaceable by hand without the need for tools.

9. A communications headset according to claim 8 wherein said microphone boom module is environmentally protected by an outer plastic sleeve.

10. A communications headset according to claim 9 wherein said microphone membrane is a polyurethane membrane.

11. A communications headset comprising an assemblage of individually replaceable modules including a) a primary ear cup receiver module comprising
an ear cushion
an ear cup membrane an ear cup sound barrier
an ear cup speaker
a printed circuit board
an ear cup shell;

b) a second ear cup receiver module comprising
an ear cushion
an ear cup membrane
an ear cup sound barrier
an ear cup speaker
an ear cup shell;

c) a termination cable module adapted at one end for removable connection to said primary ear cup receiver module and at another end for removable connection to a source of electrical communication signals;

d) a headband module adapted at one end thereof for securing and positioning said primary ear cup receiver module and said second ear cup receiver module to engage a user's ears;

e) a headband cable module removably connected to said first ear cup receiver module and said second ear cup receiver module for transmitting electrical communications signals to a speaker in said second ear cup receiver module;

f) a microphone boom module comprising:
a flexible boom, housing a microphone at one end thereof and being removably attached at an opposite end thereof to said first ear cup module; said microphone being covered by a protective microphone membrane; and said flexible boom is environmentally protected by an outer plastic sleeve;
said ear cup membrane in said primary ear cup receiver module and said ear cup membrane in said second ear cup receiver module and said microphone membrane being removable and replaceable by hand without the need for tools;
said speaker in said primary ear cup receiver module and said speaker in said second ear cup receiver module being removable and replaceable by hand without the need for tools;
said printed circuit board being removable and replaceable by hand without the need for tools;
said individually replaceable modules being replaceable by hand without the need for tools.

12. A communications headset comprising an assemblage of individually replaceable modules including:

a) a primary ear cup receiver module comprising
an ear cushion
an ear cup membrane
an ear cup plate
an ear cup foam sound barrier
an ear cup speaker
a printed circuit board
an ear cup shell;

b) a termination cable module adapted at one end for removable connection to said ear cup receiver module and at another end for removable connection to a source of electrical communication signals;

c) a headband module adapted at one end thereof for securing and positioning said ear cup receiver module to engage a users ear;
said ear cup membrane being replaceably attached over said foam sound barrier, speaker, and printed circuit board to provide an hygienic and protective cover therefore and being removable and replaceable by hand without the need for tools;
said individually replaceable modules being replaceable by hand without the need for tools;

d) a microphone boom module comprising
a flexible boom, housing a microphone at one end thereof and being removably attached at an opposite end thereof to said primary ear cup module;
said microphone being covered by a protective microphone membrane and microphone cover assembly;
said microphone boom module being removable and replaceable by hand without the need for tools;
said microphone membrane and microphone cover assembly being replaceable by hand without the need for tools;
said microphone boom module is environmentally protected by an outer plastic sleeve;
said microphone membrane being a polyurethane membrane;
said microphone membrane contains a puncture therein suitable for maintaining an equalization of pressure across said microphone membrane.

* * * * *